US010851779B2

(12) United States Patent
Koyama et al.

(10) Patent No.: US 10,851,779 B2
(45) Date of Patent: Dec. 1, 2020

(54) SCROLL COMPRESSOR HAVING GAP BETWEEN TIP SPIRAL SCROLL WRAP TO END PLATE OF FIXED AND ORBITING SCROLLS THAT DIFFERS IN AXIAL LENGTH FROM GAP BETWEEN SUPPORT OF OLDHAM RING AND END PLATE OF ORBITING SCROLL

(71) Applicant: Mitsubishi Electric Corporation, Tokyo (JP)

(72) Inventors: Shuhei Koyama, Tokyo (JP); Koji Masumoto, Tokyo (JP); Tetsuro Hirami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 155 days.

(21) Appl. No.: 16/088,850

(22) PCT Filed: Jun. 6, 2016

(86) PCT No.: PCT/JP2016/066775
§ 371 (c)(1),
(2) Date: Sep. 27, 2018

(87) PCT Pub. No.: WO2017/212527
PCT Pub. Date: Dec. 14, 2017

(65) Prior Publication Data
US 2019/0101116 A1 Apr. 4, 2019

(51) Int. Cl.
*F03C 2/00* (2006.01)
*F03C 4/00* (2006.01)
(Continued)

(52) U.S. Cl.
CPC ..... *F04C 18/0215* (2013.01); *F01C 1/063* (2013.01); *F01C 17/066* (2013.01);
(Continued)

(58) Field of Classification Search
CPC ..... F04C 18/0215; F04C 18/0246; F04C 18/0253; F04C 18/0276; F04C 18/0284;
(Continued)

(56) References Cited

U.S. PATENT DOCUMENTS 5,133,651 A * 7/1992 Onoda ..... F04C 18/0215 418/55.6
5,320,505 A * 6/1994 Misiak ..... F04C 18/0215 418/55.1
(Continued)

FOREIGN PATENT DOCUMENTS

JP H07-229484 A 8/1995
JP 3124437 B2 1/2001
JP 2003-328963 A 11/2003

OTHER PUBLICATIONS

International Search Report of the International Searching Authority dated Sep. 6, 2016 for the corresponding international application No. PCT/JP2016/066775 (and English translation).

*Primary Examiner* — Theresa Trieu
(74) *Attorney, Agent, or Firm* — Posz Law Group, PLC

(57) ABSTRACT

A scroll compressor includes an orbiting scroll including an end plate and a spiral element on the end plate, a fixed scroll including an end plate and a spiral element on the end plate, and an Oldham ring including a support. The scroll compressor satisfies a relation of $\delta 1 > \delta 2$, where $\delta 1$ denotes each of the axial length of a gap between the tip of the spiral element of the orbiting scroll and the end plate of the fixed scroll and a gap between the tip of the spiral element of the fixed scroll and the end plate of the orbiting scroll, and $\delta 2$ denotes the axial length of a gap between the end plate of the orbiting scroll and the support of the Oldham ring.

8 Claims, 8 Drawing Sheets

(51) Int. Cl.

| | |
|---|---|
| ***F04C 18/00*** | (2006.01) |
| ***F04C 2/00*** | (2006.01) |
| ***F04C 18/02*** | (2006.01) |
| ***F04C 29/00*** | (2006.01) |
| ***F01C 1/063*** | (2006.01) |
| ***F01C 17/06*** | (2006.01) |
| ***F25B 1/04*** | (2006.01) |

(52) U.S. Cl.
CPC ..... *F04C 18/0253* (2013.01); *F04C 18/0284* (2013.01); *F04C 29/0021* (2013.01); *F25B 1/04* (2013.01); *F25B 2400/121* (2013.01)

(58) Field of Classification Search
CPC F04C 23/008; F04C 29/0021; F04C 2270/17; F01C 1/063; F01C 17/06; F01C 17/066; F01C 18/08; F01C 18/10; F25B 1/04; F25B 2400/121
See application file for complete search history.

(56) References Cited

U.S. PATENT DOCUMENTS

| | | | | |
|---|---|---|---|---|
| 6,443,719 | B1 * | 9/2002 | Fenocchi | F01C 17/066 418/55.3 |
| 6,776,593 | B1 * | 8/2004 | Cho | F01C 17/066 418/55.3 |
| 7,540,726 | B2 * | 6/2009 | Matsuhashi | F04C 18/0269 418/55.2 |
| 8,672,646 | B2 * | 3/2014 | Ishizono | F04C 18/0215 418/55.1 |
| 2004/0265159 | A1 | 12/2004 | Furusho et al. | |
| 2018/0017055 | A1 * | 1/2018 | Nagaoka | F04C 18/0269 418/55.2 |

* cited by examiner

SCROLL COMPRESSOR HAVING GAP BETWEEN TIP SPIRAL SCROLL WRAP TO END PLATE OF FIXED AND ORBITING SCROLLS THAT DIFFERS IN AXIAL LENGTH FROM GAP BETWEEN SUPPORT OF OLDHAM RING AND END PLATE OF ORBITING SCROLL

CROSS REFERENCE TO RELATED APPLICATION

This application is a U.S. national stage application of PCT/JP2016/066775 filed on Jun. 6, 2016, the contents of which are incorporated herein by reference.

TECHNICAL FIELD

The present invention relates to scroll compressors mainly included in refrigeration apparatuses, air-conditioning apparatuses, and water heaters.

BACKGROUND ART

A scroll compressor includes a fixed scroll including an end plate and a spiral element on the end plate, an orbiting scroll including an end plate and a spiral element on the end plate, and a crankshaft driving the orbiting scroll, and the spiral elements of the fixed and orbiting scrolls engage with each other to define a compression chamber. In this type of scroll compressor, while performing an orbiting motion, the orbiting scroll experiences not only an axial force but also a radial force under the action of compression in the compression chamber. These forces cause the orbiting scroll to tilt, or produce an overturning moment.

When the overturning moment causes the orbiting scroll to overturn or tilt, the orbiting scroll orbits while wobbling, or exhibits unstable behavior. Combined with the tilt of the orbiting scroll, such behavior may cause gas refrigerant to leak or cause the tip of the spiral element of each of the orbiting and fixed scrolls to contact and damage the end plate of the opposite scroll, resulting in a reduction in reliability, for example.

A technique known in the art includes producing an anti-overturning moment for reducing an overturning moment to inhibit the tilt of an orbiting scroll (refer to Patent Literature 1, for example). As described in Patent Literature 1, an adjustment mechanism to produce the anti-overturning moment for reducing the overturning moment is provided in an orbiting angle area in which the overturning moment acting on the orbiting scroll has an amplitude at or above a predetermined value during the orbiting motion of the orbiting scroll.

Specifically, the adjustment mechanism has an annular oil groove, which is provided in a spiral-element protruding surface of an end plate of the orbiting scroll and faces a fixed scroll, and an oil guide path or hole, which is provided in the orbiting scroll, for guiding oil to the oil groove. In the orbiting angle area, in which the overturning moment has an amplitude at or above the predetermined value, of part of the orbiting scroll, high-pressure refrigerating machine oil is supplied to the oil groove, and the pressure of the refrigerating machine oil supplied to the oil groove is used to produce the anti-overturning moment.

CITATION LIST

Patent Literature

Patent Literature 1: Japanese Unexamined Patent Application Publication No. 2003-328963

SUMMARY OF INVENTION

Technical Problem

In a scroll compressor disclosed in Patent Literature 1, the adjustment mechanism for reducing the overturning moment is provided in the orbiting scroll. As described above, the adjustment mechanism has the groove and the hole. Such a configuration inevitably causes a reduction in rigidity of the orbiting scroll. The orbiting scroll needs to be designed in consideration of a reduction in rigidity caused by providing the adjustment mechanism. An orbiting scroll and a fixed scroll are essential parts of a compression mechanism. It is required to prevent the tilt of the orbiting scroll without changing the structures of these essential parts.

The present invention has been made to overcome the above-described problems, and aims to provide a scroll compressor in which excessive tilt of an orbiting scroll is prevented with a simple configuration.

Solution to Problem

A scroll compressor according to an embodiment of the present invention includes a fixed scroll including an end plate and a spiral element on the end plate and an orbiting scroll including an end plate and a spiral element on the end plate of the orbiting scroll. The spiral element of the orbiting scroll engages with the spiral element of the fixed scroll to define a compression chamber. The scroll compressor further includes a crankshaft configured to drive the orbiting scroll, a frame that supports the orbiting scroll across the orbiting scroll from the fixed scroll, and an Oldham ring disposed between the end plate of the orbiting scroll and the frame. The Oldham ring is configured to prevent the orbiting scroll from rotating to allow the orbiting scroll to orbit against the fixed scroll. The Oldham ring includes a ring portion that is annular, and a surface of the ring portion facing the end plate of the orbiting scroll includes a support to contact the orbiting scroll when the orbiting scroll tilts during an orbiting motion of the orbiting scroll. The scroll compressor satisfies a relation of $\delta 1>\delta 2$, where $\delta 1$ denotes the axial length of each of a gap between the tip of the spiral element of the orbiting scroll and the end plate of the fixed scroll and a gap between the tip of the spiral element of the fixed scroll and the end plate of the orbiting scroll, and $\delta 2$ denotes the axial length of a gap between the end plate of the orbiting scroll and the support of the Oldham ring.

Advantageous Effects of Invention

According to an embodiment of the present invention, such a simple configuration that satisfies the relation of $\delta 1>\delta 2$ inhibits excessive tilt of the orbiting scroll.

DESCRIPTION OF EMBODIMENTS

Embodiments of the present invention will be described below. The present invention is not limited to Embodiments described below. Furthermore, note that components designated by the same reference signs in the figures are the same components or equivalents. The reference signs are used for the description throughout the specification. Furthermore, note that the forms of components described in the specification are intended to be illustrative only and are not limited to the descriptions.

Embodiment 1

Embodiment 1 will be described with reference to FIGS. 1 to 5.

Figure 1:
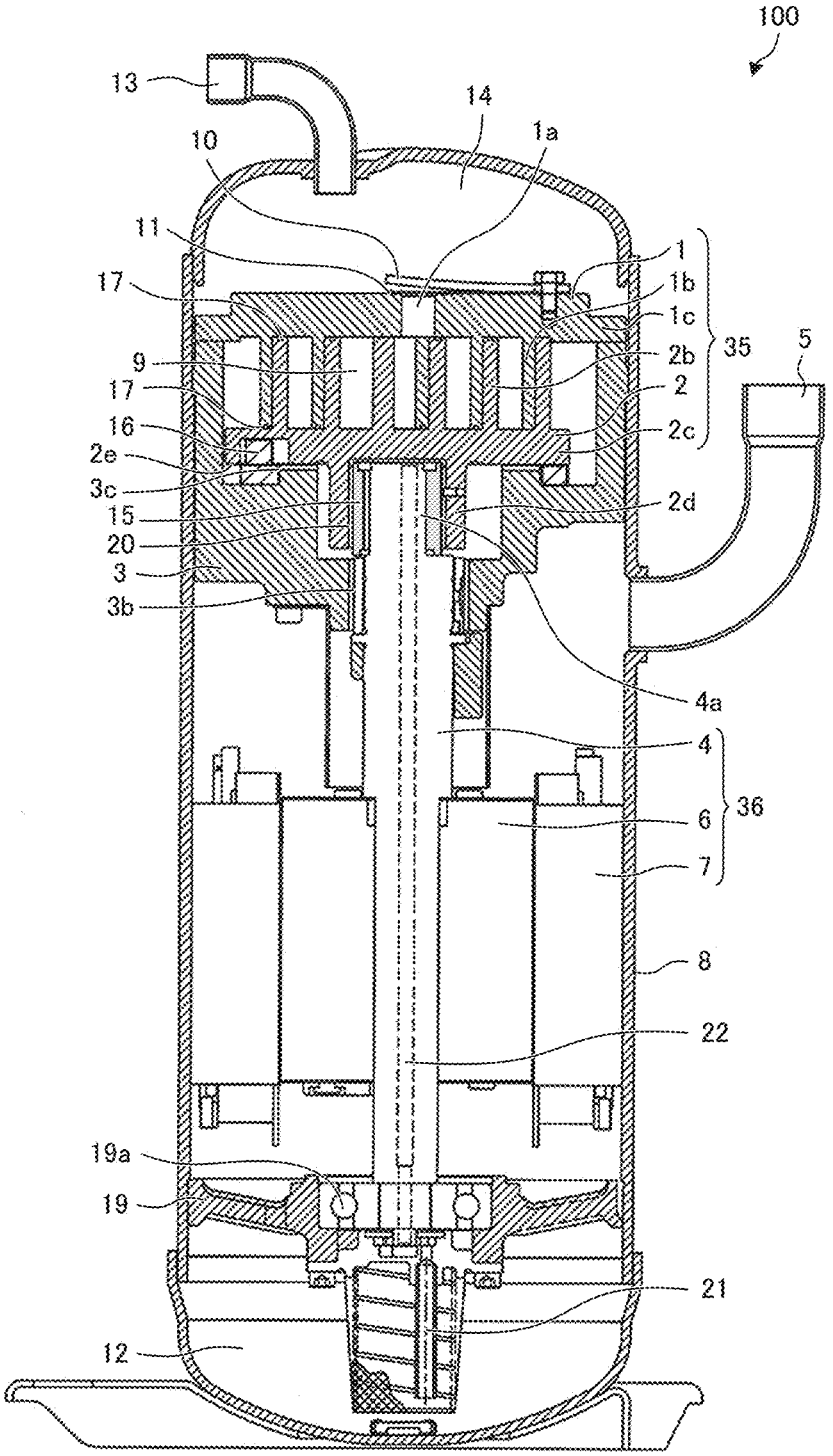
FIG. 1 is a schematic sectional view of a scroll compressor according to Embodiment 1 of the present invention.

FIG. 1 is a schematic sectional view of a scroll compressor according to Embodiment 1 of the present invention.

This scroll compressor has the function of sucking fluid, such as refrigerant, compressing the fluid into a high-temperature, high-pressure state, and discharging the fluid. The scroll compressor includes a shell 8, constituting an outer casing and serving as a sealed container, a compression mechanism 35, and a drive mechanism 36. The shell 8 accommodates these mechanisms and other components. As illustrated in FIG. 1, the compression mechanism 35 is disposed in upper part of the shell 8, and the drive mechanism 36 is disposed in lower part of the shell 8. Bottom part of the shell 8 serves an oil sump 12.

In the oil sump 12, an oil pump 21, which is a positive displacement pump, fixed to a lower end of a crankshaft 4 is immersed in refrigerating machine oil. The oil pump 21 performs the function, as the crankshaft 4 rotates, of supplying the refrigerating machine oil held in the oil sump 12 to sliding parts (a recessed bearing 2*d*, a bearing 3*b*, and a thrust bearing 3*c*, which will be described later) through an oil circuit 22 disposed in the crankshaft 4.

The shell 8 further includes a suction pipe 5 through which the fluid is sucked and a discharge pipe 13 through which the fluid is discharged.

The shell 8 includes a frame 3 secured to the inside of the shell 8. The frame 3 is secured to an inner circumferential surface of the shell 8. The bearing 3*b* supporting the crankshaft 4 is disposed in central part of the shell 8 in such a manner that the crankshaft 4 can rotate. An outer circumferential surface of the frame 3 may be secured to the inner circumferential surface of the shell 8 by, for example, shrink fitting or welding. The shell 8 further includes a subframe 19 secured to the inside of the shell 8. The subframe 19 is secured to the inner circumferential surface of the shell 8. A sub bearing 19*a* supporting the crankshaft 4 is disposed in central part of the shell 8 in such a manner that the crankshaft 4 can rotate. The frame 3 is secured to the upper part of the shell 8, and the subframe 19 is secured to the lower part of the shell 8.

The compression mechanism 35 has the function of compressing the fluid sucked through the suction pipe 5 and forcing the fluid to flow into a high-pressure space 14 located in the upper part of the shell 8. The high-pressure fluid that has flowed into the high-pressure space 14 is discharged out of the scroll compressor through the discharge pipe 13.

The drive mechanism 36 performs the function of driving an orbiting scroll 2, which is included in the compression mechanism 35, to cause the compression mechanism 35 to compress the fluid. Specifically, the drive mechanism 36 drives the orbiting scroll 2 via the crankshaft 4, thus causing the compression mechanism 35 to compress the fluid.

The compression mechanism 35 includes a fixed scroll 1 and the orbiting scroll 2. With reference to FIG. 1, the orbiting scroll 2 is disposed lower than the fixed scroll 1, and the fixed scroll 1 is disposed higher than the orbiting scroll 2. The fixed scroll 1 includes a first end plate 1*c* and a first spiral element 1*b*, serving as a scroll lap, extending from one surface of the first end plate 1*c*. The orbiting scroll 2 includes a second end plate 2*c* and a second spiral element 2*b*, serving as a scroll lap, extending from one surface of the second end plate 2*c*. The first spiral element 1*b* and the second spiral element 2*b* are formed to follow an involute curve. The fixed scroll 1 and the orbiting scroll 2 are mounted in the shell 8 in such a manner that the first spiral element 1*b* and the second spiral element 2*b* engage with each other. The first spiral element 1*b* and the second spiral element 2*b* define a plurality of compression chambers 9, which decrease in volume as the plurality of compression chambers 9 move radially inward, between the first spiral element 1*b* and the second spiral element 2*b*.

The fixed scroll 1 and the orbiting scroll 2 need to be spaced apart from each other by a small axial gap so that thermal-expansion-induced contact between the fixed scroll 1 and the orbiting scroll 2 and seizing up of the fixed scroll 1 and the orbiting scroll 2 are prevented during operation. Specifically, a gap 18 (refer to FIG. 3, which will be described later) is provided between the first spiral element 1*b* and the second end plate 2*c*, and a gap 18 is provided between the second spiral element 2*b* and the first end plate 1*c*. A sealing part 17 for preventing the fluid that is being compressed from leaking through the gap 18 is disposed on the tip of each of the first spiral element 1*b* and the second spiral element 2*b*.

The fixed scroll 1 is fixed in the shell 8 by the frame 3. The fixed scroll 1 has a centrally disposed discharge port 1*a*, through which the compressed high-pressure fluid is discharged. A valve 11 including a flat spring for covering an outlet opening of the discharge port 1*a* to prevent backflow of the fluid is disposed at the outlet opening of the discharge port 1*a*. A valve hold-down part 10 for limiting the amount of lift of the valve 11 is disposed adjacent to one end of the valve 11. Specifically, when the fluid is compressed up to a predetermined pressure in the compression chambers 9, the valve 11 is lifted against its elastic force, so that the compressed fluid is discharged from the discharge port 1*a* into the high-pressure space 14. The fluid discharged in the high-pressure space 14 is discharged out of the scroll compressor through the discharge pipe 13.

An Oldham ring 16 prevents the orbiting scroll 2 from rotating to allow the orbiting scroll 2 to eccentrically orbit against the fixed scroll 1. The second end plate 2*c* of the orbiting scroll 2 includes the recessed bearing 2*d*, which has a hollow cylindrical shape, for receiving a driving force in such a manner that the recessed bearing 2*d* is located in central part of a surface (hereinafter, referred to as a "rear surface") 2*e* opposite the surface from which the second spiral element 2*b* extends. A substantially cylindrical bushing 15 is fitted in the recessed bearing 2*d* with an orbiting bearing 20 interposed between the bushing 15 and the recessed bearing 2*d* in such a manner that the bushing 15 can rotate. The bushing 15 receives an eccentric pin 4*a*, which is located on an upper end of the crankshaft 4 and is eccentric to the axis of the crankshaft 4. The rear surface 2*e* of the orbiting scroll 2 is axially supported by the thrust bearing 3*c* provided in the frame 3.

The drive mechanism 36 includes at least a stator 7 secured to and held in the shell 8, a rotor 6 disposed adjacent to an inner circumferential surface of the stator 7, in such a manner that the rotor 6 can rotate, and fixed to the crankshaft 4, and the crankshaft 4, serving as a rotary shaft, vertically accommodated in the shell 8. The stator 7 has the function of driving the rotor 6 to rotate when the stator 7 is energized. An outer circumferential surface of the stator 7 is secured to the shell 8 by, for example, shrink fitting, and is supported by the shell 8. The rotor 6 is driven to rotate when the stator 7 is energized, and has the function of rotating the crankshaft 4. The rotor 6 is fixed to an outer circumferential surface of the crankshaft 4. The rotor 6 has a permanent magnet in the rotor 6 and is held at a small distance from the stator 7.

The crankshaft 4 is rotated in association with the rotation of the rotor 6, thus driving and causing the orbiting scroll 2 to orbit. Upper part of the crankshaft 4 is supported by the bearing 3*b* of the frame 3, and lower part of the crankshaft 4 is supported by the sub bearing 19*a* of the subframe 19 in such a manner that the crankshaft 4 can rotate. As described above, the eccentric pin 4*a* provided on the upper end of the crankshaft 4 is coupled to the recessed bearing 2*d* with the bushing 15 and the orbiting bearing 20 interposed between the eccentric pin 4*a* and the recessed bearing 2*d*. The rotation of the crankshaft 4 causes the orbiting scroll 2 to eccentrically orbit.

In the shell 8, the Oldham ring 16 for inhibiting a rotating motion of the orbiting scroll 2 during the eccentric orbiting motion is disposed outward of the thrust bearing 3*c*.

Figure 2:
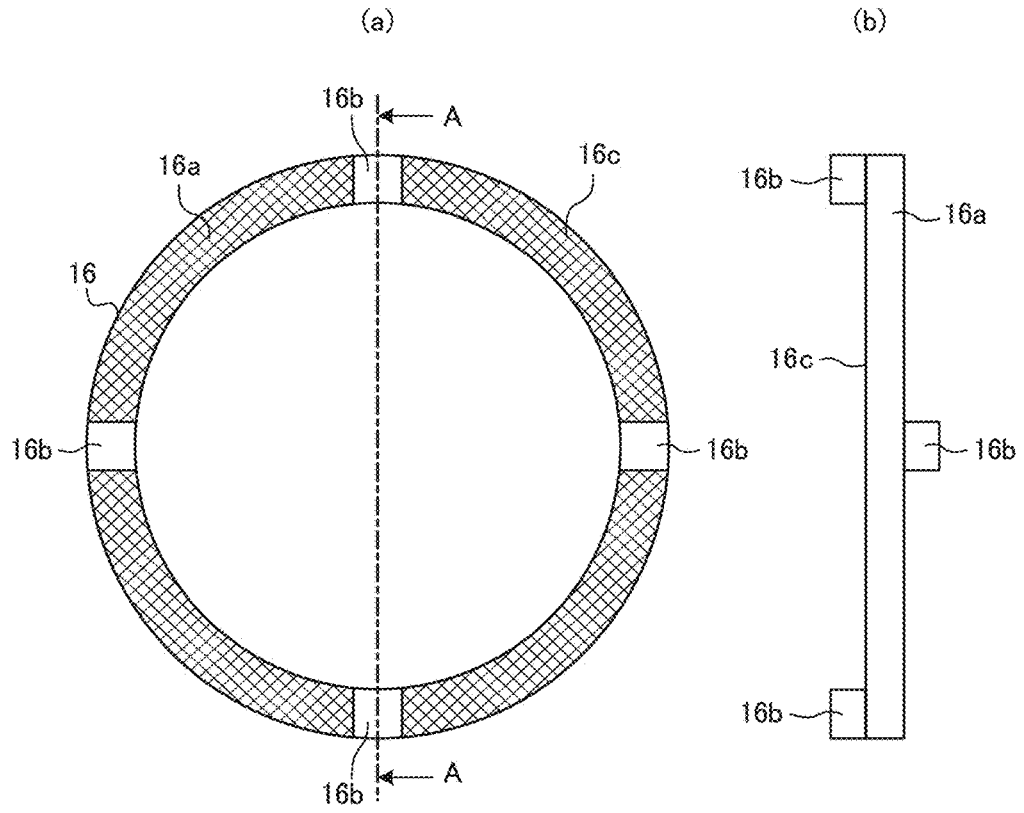
FIG. 2 illustrates an Oldham ring in FIG. 1, (a) being a schematic view of the Oldham ring as viewed axially from above, (b) being a cross-sectional view taken along the line A-A in (a).

FIG. 2 illustrates the Oldham ring in FIG. 1, (a) is a schematic view of the Oldham ring as viewed axially from above, and (b) is a cross-sectional view taken along the line A-A in (a).

The Oldham ring 16 includes an annular ring portion 16*a* disposed close to the outer circumferential surface of the crankshaft 4 and Oldham keys 16*b* protruding from upper and lower surfaces of the ring portion 16*a*. The two Oldham keys 16*b* are arranged on each of the upper and lower surfaces of the ring portion 16*a*. The adjacent Oldham keys 16*b* on the ring portion 16*a*, including the upper and lower surfaces, are arranged at a pitch of 90 degrees.

The Oldham ring 16 with such a configuration is disposed between the orbiting scroll 2 and the frame 3 in such a manner that the Oldham keys 16*b* are positioned in a groove arranged in each of the orbiting scroll 2 and the frame 3. This arrangement allows the Oldham ring 16 to inhibit the rotating motion of the orbiting scroll 2 and enable the orbiting motion of the orbiting scroll 2.

Hatched portions in FIG. 2(*a*) each indicate a support 16*c* to contact the orbiting scroll 2 when the orbiting scroll 2 tilts during the orbiting motion. The hatched portions are four arc-shaped portions, as viewed in plan, of a surface of the ring portion 16*a* facing the second end plate 2*c* of the orbiting scroll 2. The four arc-shaped portions have a central angle of 90 degrees and the same shape with no Oldham key 16*b*.

Figure 3:
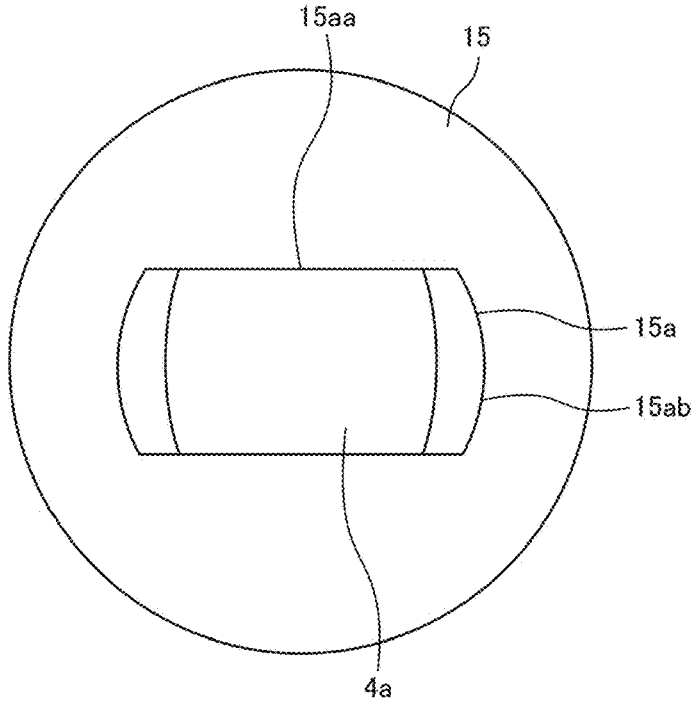
FIG. 3 is a schematic view of an eccentric pin on a crankshaft fitted in a bushing in FIG. 1 as viewed axially from above.

FIG. 3 is a schematic view of the eccentric pin on the crankshaft fitted in the bushing in FIG. 1 as viewed axially from above.

The bushing 15 has a centrally disposed slide hole 15*a*. The slide hole 15*a* of the bushing 15 is an elongated hole having a pair of flat parts 15*aa* and a pair of curved parts 15*ab* connecting opposite ends of the pair of flat parts 15*aa*. The slide hole 15*a* receives the eccentric pin 4*a* on the crankshaft 4 in such a manner that the eccentric pin 4*a* is slidable radially along the pair of flat parts 15*aa*. As the crankshaft 4 rotates, the bushing 15 moves radially along the pair of flat parts 15*aa*, and the orbiting scroll 2 is pressed against the fixed scroll 1, thus achieving a driven crank mechanism improving sealability of the compression chambers 9.

An operation of a compressor 100 will be briefly described below.

When power is supplied to a power terminal, which is not illustrated and provided in the shell 8, torque is generated in the stator 7 and the rotor 6, so that the crankshaft 4 rotates. The rotation of the crankshaft 4 is transmitted to the orbiting scroll 2 via the bushing 15. The orbiting scroll 2 performs the eccentric orbiting motion while being inhibited from rotating by the Oldham ring 16.

Gas refrigerant sucked into the shell 8 through the suction pipe 5 is trapped into the compression chambers 9. The compression chambers 9 trapping the gas decrease in volume as the compression chambers 9 move toward the center of the orbiting scroll 2 from the outer periphery of the orbiting scroll 2 in association with the eccentric orbiting motion of the orbiting scroll 2, thus compressing the refrigerant. The compressed gas refrigerant is discharged against the valve 11 from the discharge port 1*a* in the fixed scroll 1 and is then ejected out of the shell 8 through the discharge pipe 13. The valve hold-down part 10 regulates the deformation of the valve 11 so that the valve 11 is not deformed more than necessary, thus preventing the valve 11 from being broken.

During the eccentric orbiting motion of the orbiting scroll 2, the orbiting scroll 2 experiences a centrifugal force, so that the orbiting scroll 2 is moved radially together with the bushing 15. Consequently, the first spiral element 1*b* of the fixed scroll 1 comes into close contact with the second spiral element 2*b* of the orbiting scroll 2. This operation prevents the refrigerant in the compression chambers 9 from leaking from a high-pressure side to a low-pressure side, thus achieving efficient compression.

Figure 4:
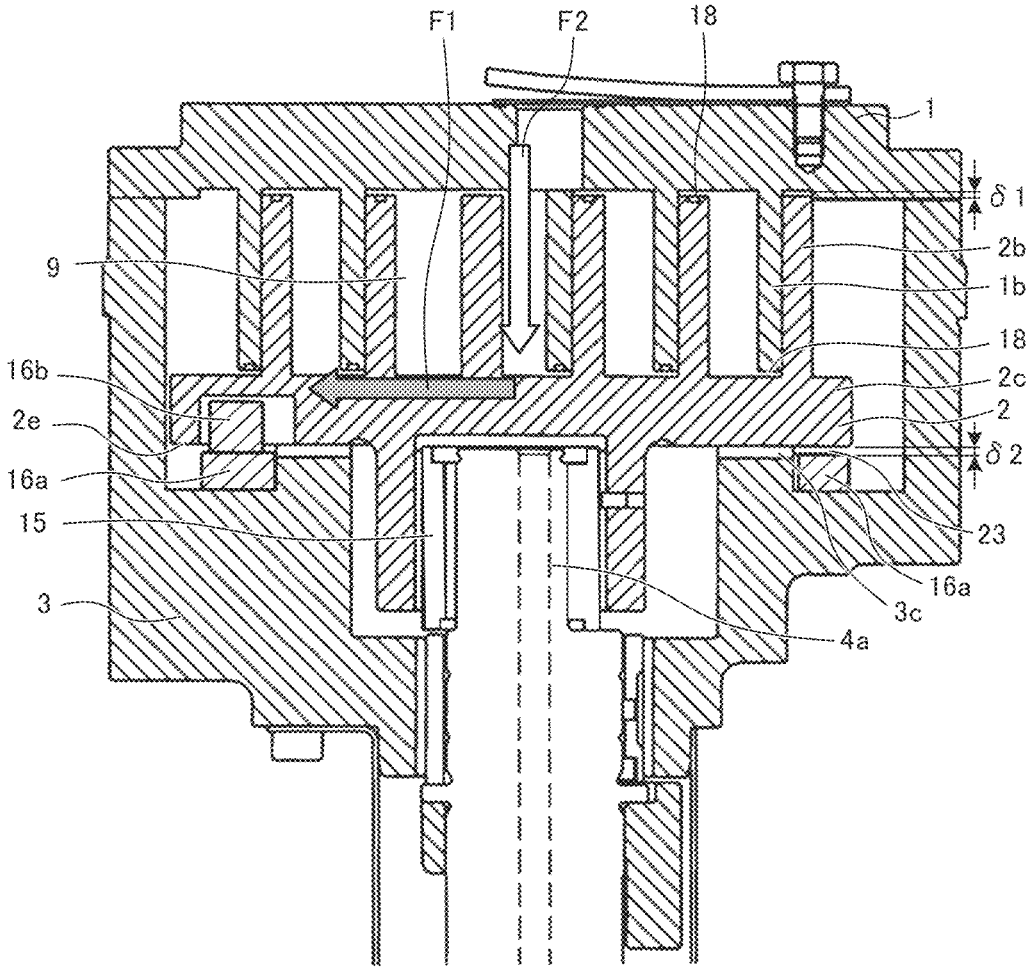
FIG. 4 is a schematic enlarged view of a compression mechanism in FIG. 1.

FIG. 4 is a schematic enlarged view of the compression mechanism in FIG. 1.

The orbiting scroll 2 experiences the centrifugal force directed radially and further experiences a radial reaction force, acting at a different angle from the centrifugal force, generated by compression of the gas refrigerant. Consequently, the orbiting scroll 2 experiences a radial resultant force F1 of these forces. Furthermore, the orbiting scroll 2 experiences an axial pressure difference between the compression chambers 9 and a surrounding space caused by compression of the gas refrigerant. Consequently, the orbiting scroll 2 experiences an axial downward force (hereinafter, referred to as a "thrust load") F2 caused by the pressure difference, so that the orbiting scroll 2 is pressed against the thrust bearing 3*c*.

The thrust load F2, which acts on the orbiting scroll 2, deforms the second end plate 2*c* in such a manner that central part of the second end plate 2*c* is curved downward. As the thrust bearing 3*c* supporting the thrust load F2, or a supporting point that supports the thrust load F2, is closer to the center of the second end plate 2*c*, the amount of deformation of the second end plate 2*c* can be reduced. When the amount of deformation of the second end plate 2*c* can be reduced, an oil film is easily formed on the thrust bearing 3*c*, thus increasing the reliability as a bearing. Although the thrust bearing 3*c* can be disposed outward of the Oldham ring 16, it is desirable that the Oldham ring 16 be disposed outward of the thrust bearing 3*c* because the supporting point is closer to the center of the second end plate 2*c* and the reliability of the thrust bearing 3*c* is thus increased.

As described above, the orbiting scroll 2 in operation experiences not only the axial force (thrust load F2) but also the radial force (resultant force F1) under the action of compression. These forces produce an overturning moment M. As the radial resultant force F1 acting on the orbiting scroll 2 becomes larger than the thrust load F2, the overturning moment M increases.

Figure 5:
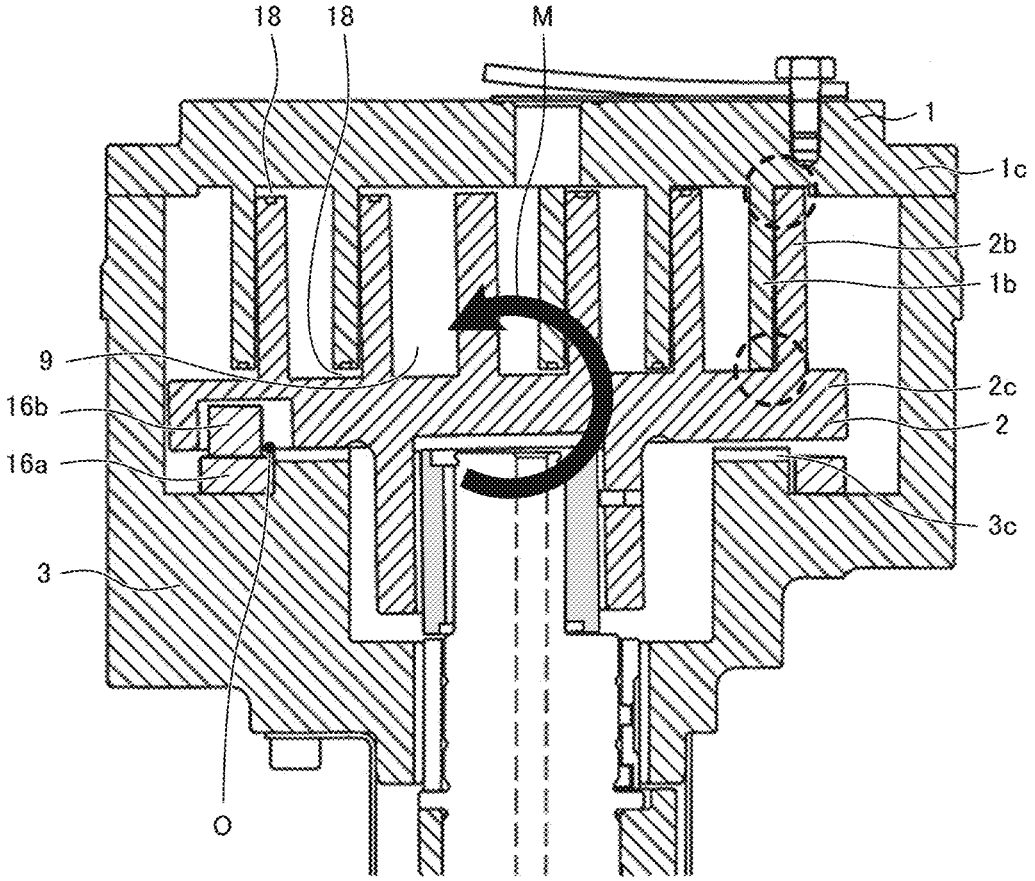
FIG. 5 Related Art
FIG. 5 is a schematic view of Comparative Example and illustrates a state in which an orbiting scroll tilts.
Figure 6:
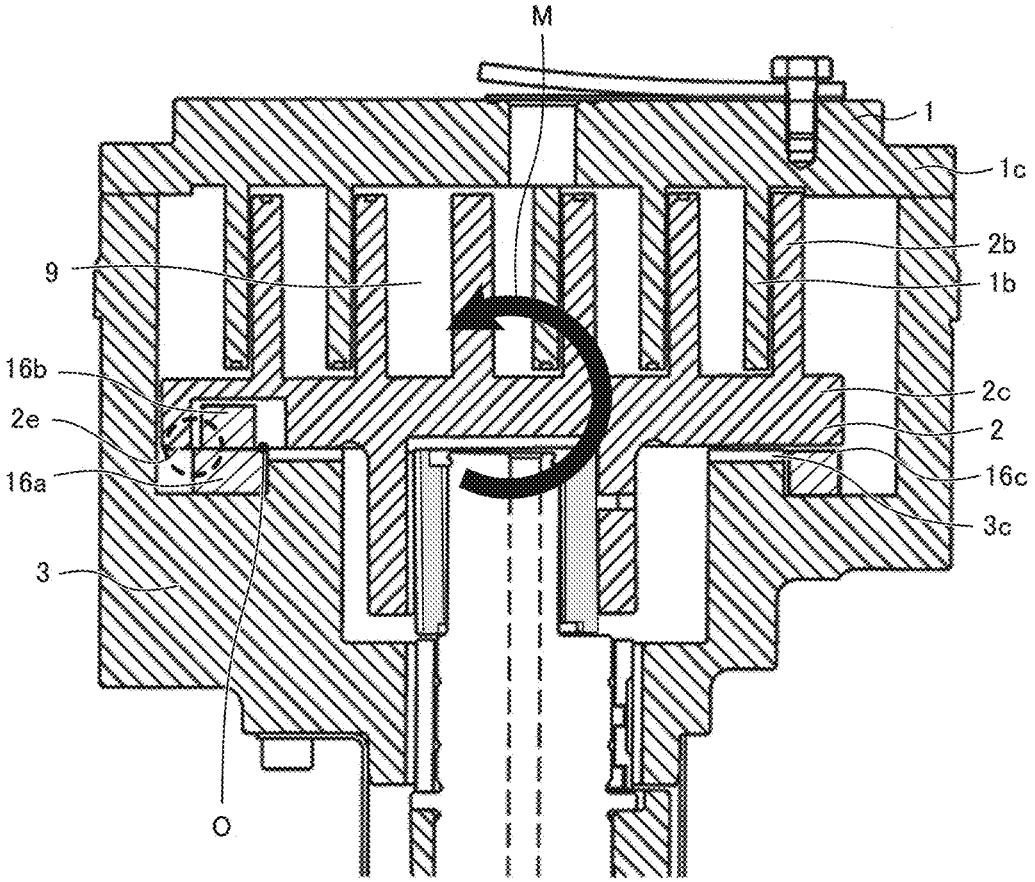
FIG. 6 is a schematic view of the scroll compressor according to Embodiment 1 of the present invention and illustrates a state in which an orbiting scroll tilts.

FIG. 5 is a schematic view of Comparative Example and illustrates a state in which the orbiting scroll tilts. FIG. 6 is a schematic view of the scroll compressor according to Embodiment 1 of the present invention and illustrates a state in which the orbiting scroll tilts.

When the overturning moment M occurs, the orbiting scroll 2 tilts about a fulcrum O, serving as an edge of the thrust bearing 3*c*, as illustrated in FIG. 5. At this time, when the orbiting scroll 2 tilts until the first spiral element 1*b* contacts the second end plate 2*c* or the second spiral element 2*b* contacts the first end plate 1*c* as illustrated in two dashed-line circles in FIG. 5, the following problems may arise. The first spiral element 1*b* and the second spiral element 2*b* may be damaged, leading to a reduction in reliability. The sealing parts 17 may provide poor sealing, leading to a decline in performance.

During operation of the compressor 100, the temperature in the compression chambers 9 rises, and the gaps 18 decrease due to thermal expansion of, for example, the first spiral element 1*b* and the second spiral element 2*b*. Consequently, the tilt of the orbiting scroll 2 decreases, resulting in a reduction in impact caused by the contact between the first spiral element 1*b* and the second end plate 2*c* or the contact between the second spiral element 2*b* and the first end plate 1*c* as well as a reduction in rate of decline in performance.

For example, just after activation, the temperature in the compression chambers 9 is low, and the first spiral element 1*b* and the second spiral element 2*b* are not expanded. Under such conditions, the gaps 18 are larger than those during the operation. The degree of tilt of the orbiting scroll 2 caused by the overturning moment M increases accordingly. It is therefore required to keep the orbiting scroll 2 from tilting due to the overturning moment M at low temperatures of the compression chambers 9.

As a feature of Embodiment 1, as illustrated in FIG. 4, the configuration satisfies the relation of $\delta 1 > \delta 2$, where $\delta 1$ denotes the axial length of each of the gap 18 between the tip of the second spiral element 2*b* of the orbiting scroll 2 and the first end plate 1*c* of the fixed scroll 1 and the gap 18 between the tip of the first spiral element 1*b* of the fixed scroll 1 and the second end plate 2*c* of the orbiting scroll 2, and $\delta 2$ denotes the axial length of a gap 23 between the rear surface 2*e* of the second end plate 2*c* of the orbiting scroll 2 and the supports 16*c* of the Oldham ring 16.

These dimensions may be adjusted by selective fitting of parts during, for example, assembly, or adjusting the thickness of the Oldham ring 16. The dimensions to be adjusted are not dimensions under conditions where the parts thermally expand due to an increase in temperature during the operation, but dimensions at room temperature. The dimension of each gap 18 at room temperature is set to approximately several tens of micrometers in consideration of temperature-increase-induced expansion or pressure-induced deformation of the compression mechanism 35 during the operation.

In Embodiment 1, the configuration that satisfies the relation of $\delta 1 > \delta 2$ prevents excessive tilt of the orbiting scroll 2. Specifically, even when the overturning moment M is large and the orbiting scroll 2 is about to tilt excessively, the rear surface 2*e* of the orbiting scroll 2 contacts any of the supports 16*c* of the ring portion 16*a*, as illustrated in a dashed-line circle in FIG. 6, before the first spiral element 1*b* contacts the second end plate 2*c* or the second spiral element 2*b* contacts the first end plate 1*c*. Consequently, even when the orbiting scroll 2 is about to tilt excessively due to the overturning moment M under conditions where each gap 18 is large just after, for example, activation, the orbiting scroll 2 is inhibited from tilting excessively. This operation prevents damage to the first spiral element 1*b* and the second spiral element 2*b* and poor sealing by the sealing parts 17, thus enhancing the performance.

The portion that supports the orbiting scroll 2 when the orbiting scroll 2 tilts is any of the supports 16*c*, represented by the hatched portions in FIG. 2(*a*), of the Oldham ring 16. As the Oldham ring 16 supports the orbiting scroll 2, the Oldham ring 16 is preferably made from a material that ensures adequate strength and provides good slidability. For the material for the Oldham ring 16, consequently, carbon steel for machine construction or an iron-based sintered material subjected to hardening or tempering is used to ensure adequate strength. When aluminum is used as the material for the Oldham ring 16, an aluminum die-casting or an aluminum forging is used to ensure adequate strength.

To improve the slidability of the orbiting scroll 2, the Oldham ring 16 may include a surface treatment layer obtained by surface treatment, such as nitriding, manganese phosphating, and diamond-like carbon (DLC). Other methods for improving the slidability include attaching a separate part to the rear surface 2*e* of the orbiting scroll 2. Examples of the separate part include a high-strength steel sheet and a thin aluminum sheet. The separate part may be attached to the orbiting scroll 2 by using screws, for example. To prevent adhesion of the separate part to the orbiting scroll 2, the separate part is preferably made from a material different from that for the orbiting scroll 2.

As for the configuration of the compressor 100, the overturning moment M acting on the orbiting scroll 2 may increase in the following two cases, for example. In one of the cases, the centrifugal force acting on the orbiting scroll 2 is much larger than the thrust load F2 that presses the orbiting scroll 2 axially downward. Such a case, in which an excessive centrifugal force is generated, corresponds to either of a configuration in which the compressor 100 is operated up to a high rotation frequency and a configuration in which the orbiting scroll 2 is heavy. These configurations are intended to ensure refrigeration capacity, heating capacity, or water heating capacity. In the other case, the first spiral element 1*b* and the second spiral element 2*b* are axially long, and the point of application of a reaction force during compression of the gas refrigerant is located above the thrust bearing 3*c*.

Preventing global warming currently requires switchover om traditional HFC refrigerants to refrigerants having low global warming potential (GWP). Examples of the low GWP refrigerants include HFO refrigerants, such as 2,3,3,3-tetrafluoro-1-propene (HFO-1234yf). Such a refrigerant has a low refrigeration capacity per unit volume. To use a single component HFO refrigerant or a refrigerant mixture containing the HFO refrigerant to achieve the same refrigeration capacity, heating capacity, or water heating capacity as those achieved by using a traditional HFC refrigerant, the following operation is needed.

Specifically, the compressor 100 needs to be operated at a high rotation frequency to increase a discharge flow rate per unit time. Or alternatively, the compression mechanism 35 needs to be increased in size to increase a discharge flow rate per rotation. An increase in size of the compression mechanism 35 leads to an increase in weight of the orbiting scroll 2. In other words, the use of a single component HFO refrigerant or a refrigerant mixture containing the single component HFO refrigerant inevitably requires a configuration that tends to cause an excessive centrifugal force, resulting in an increase in overturning moment M.

Furthermore, the use of a refrigerant mixture containing the HFO refrigerant causes an operating pressure to be lower than that in the use of the HFC refrigerant, resulting in a reduction in thrust load F2. Consequently, the centrifugal force acting on the orbiting scroll 2 is larger than the thrust load F2, also resulting in an increase in overturning moment M.

In either case, the use of a single component HFO refrigerant or a refrigerant mixture containing the single component HFO refrigerant causes the overturning moment M to be larger than that in the use of the HFC refrigerant because of the above-described reasons. Consequently, the configuration according to Embodiment 1, or the configuration in which, when the orbiting scroll 2 tilts, the orbiting scroll 2 can be supported by any of the supports 16*c* of the Oldham ring 16 before the first spiral element 1*b* contacts the second end plate 2*c* or the second spiral element 2*b* contacts the first end plate 1*c*, exerts effects on a compressor in which a single component HFO refrigerant or a refrigerant mixture containing the single component HFO refrigerant is used.

Although a single component refrigerant of HFO-1234yf and a refrigerant mixture containing the single component refrigerant have been described as examples of the refrigerant, the refrigerant usable is not limited to these examples. For example, a single component refrigerant or a refrigerant mixture containing the single component refrigerant may be used. The single component refrigerant has a molecular formula expressed as $C_3H_mF_n$ and one double bond in a molecular structure of the single component refrigerant, where m and n are each an integer of 1 to 5 and the relation of m+n=6 is satisfied.

According to Embodiment 1, as described above, the configuration that satisfies the relation of $\delta1>\delta2$ inhibits the orbiting scroll 2 from tilting excessively. This configuration can prevent damage to the first spiral element 1*b* and the second spiral element 2*b* and poor sealing by the sealing parts 17, and thus enhance the performance.

In preventing the orbiting scroll 2 from tilting excessively, any change in structure of the orbiting scroll 2 and the fixed scroll 1 is not needed. It is only required that the axial lengths of the gaps $\delta1$ and $\delta2$ are adjusted. The prevention can be achieved with such a simple configuration.

Furthermore, the axial lengths of the gaps can be adjusted only by adjusting the thickness of the Oldham ring 16 without changing the existing design and dimensions of the compression mechanism 35. The present invention can be easily applied to existing compressors.

Embodiment 2

Embodiment 2 differs from Embodiment 1 in the configuration of the supports 16*c* of the Oldham ring 16. The following description will be focused on the difference between Embodiment 1 and Embodiment 2. Components and parts that are not mentioned in Embodiment 2 are similar to those in Embodiment 1.

Figure 7:
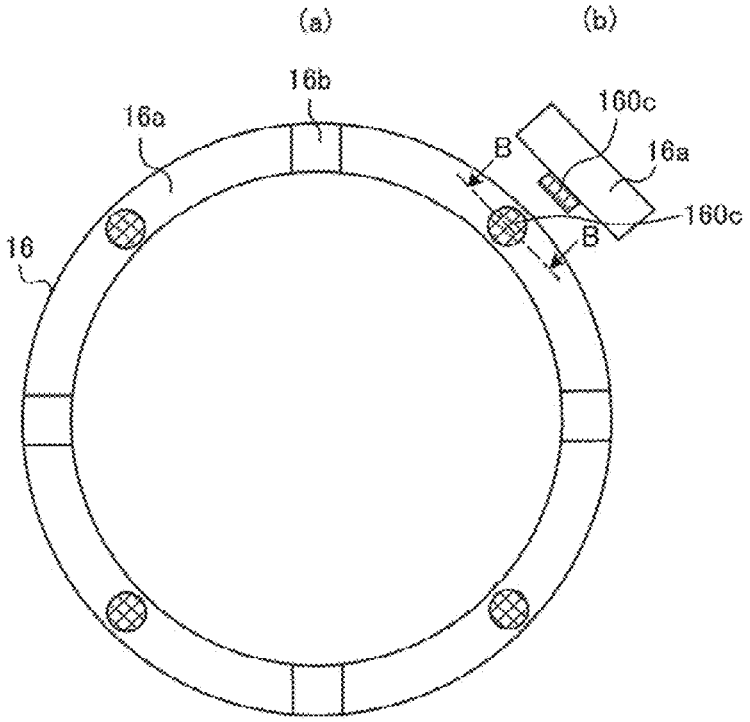
FIG. 7 illustrates an Oldham ring of a scroll compressor according to Embodiment 2 of the present invention, (a) being a schematic view of the Oldham ring as viewed axially from above, (b) being a sectional view taken along the line B-B in (a).

FIG. 7 illustrates an Oldham ring of a scroll compressor according to Embodiment 2 of the present invention, (a) is a schematic view of the Oldham ring as viewed axially from above, and (b) is a sectional view taken along the line B-B in (a).

The Oldham ring 16 in Embodiment 2 includes a plurality of supports 160*c* having a lower axial height than the Oldham keys 16*b* and protruding from the ring portion 16*a*. Each support 160*c* is disposed on the surface of the ring portion 16*a* facing the rear surface 2*e* of the orbiting scroll 2. The support 160*c* is at least one protrusion located in each of four arc-shaped portions, which are defined by circumferentially equally dividing the surface of the ring portion 16*a* facing the rear surface 2*e* of the orbiting scroll 2 into four areas.

In the configuration according to Embodiment 1 described above, when the overturning moment M causes the orbiting scroll 2 to tilt, the orbiting scroll 2 contacts any of the supports 16*c* of the Oldham ring 16. Consequently, the height of the entire upper surfaces of the supports 16*c*, or the arc-shaped portions, to contact the orbiting scroll 2 is an important factor in satisfying the relation of $\delta1>\delta2$. In other words, it is important to enhance the accuracy of thickness of the whole of each of the arc-shaped portions represented by hatching in FIG. 2. To enhance the accuracy of thickness of the whole of each arc-shaped portion, the thickness needs to be adjusted by, for example, polishing or grinding.

In Embodiment 2, rather than the whole of each of the four arc-shaped portions, part of the arc-shaped portion constitutes the support 160*c*.

As the parts of the arc-shaped portions are used to support the orbiting scroll 2, Embodiment 2 offers the following advantages in addition to the same advantages as those in Embodiment 1: the area of parts required to have high accuracy of thickness is reduced, leading to a lower manufacturing cost than that in Embodiment 1.

In addition to the above-described configuration of the Oldham ring 16 illustrated in FIG. 7, the following modifications may be used. Such modifications offer the same advantages as those in Embodiment 2.

Modification 1

Figure 8:
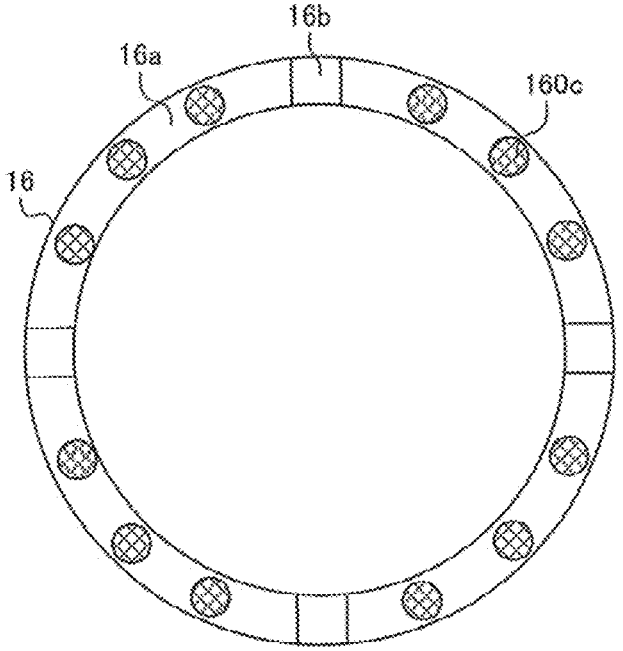
FIG. 8 is a diagram of Modification 1 and illustrates a modification of the Oldham ring of FIG. 7.

FIG. 8 is a diagram of Modification 1 and illustrates a modification of the Oldham ring of FIG. 7.

Although the four supports 160*c* are arranged in FIG. 7, four or more supports may also be arranged as illustrated in FIG. 8. As described above, the two Oldham keys 16*b* are arranged on each of the upper and lower surfaces of the ring portion 16*a* of the Oldham ring 16, and the adjacent Oldham keys 16*b* on the ring portion 16*a*, including the upper and lower surfaces, are arranged at a pitch of 90 degrees. In consideration of supporting the rear surface 2*e* of the orbiting scroll 2, it is preferred that four or more supports 160*c* be arranged.

Modification 2

Figure 9:
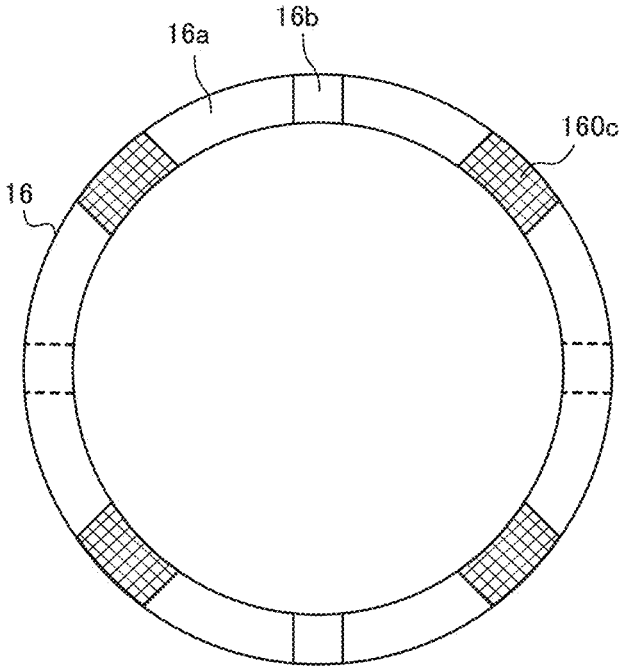
FIG. 9 is a diagram of Modification 2 and illustrates another modification of the Oldham ring of FIG. 7.

FIG. 9 is a diagram of Modification 2 and illustrates another modification of the Oldham ring of FIG. 7.

Although the supports 160*c* illustrated in FIG. 7 have a cylindrical shape, the supports 160*c* may be shaped along the ring portion 16*a* as illustrated in FIG. 9. Although not illustrated, the supports 160*c* may have a rectangular shape or an oval shape in plan view.

As regards the arrangement of the supports 160*c* illustrated in FIGS. 7 to 9, in a case where one support is disposed in each arc-shaped portion, the supports are arranged circumferentially at equal intervals. In a case where multiple supports are arranged in each arc-shaped portion, the arc-shaped portions have the same arrangement pattern of the supports 160*c*. As described above, it is preferred that the arrangement of the supports 160*c* be well-balanced.

The scroll compressor according to the present invention is not limited to that having the Oldham ring 16. Further, the scroll compressor according to the present invention is not limited to that having other structural details in FIG. 1. The scroll compressor can be variously modified, for example, as follows without departing from the spirit and scope of the present invention.

Modification 3

The scroll compressor according to each of Embodiments 1 and 2 includes the driven crank mechanism in which, as described above, as the crankshaft 4 rotates, the bushing 15 radially moves along the flat parts 15*aa* of the slide hole 15*a*, and the movement causes the second spiral element 2*b* of the orbiting scroll 2 to be pressed against the first spiral element 1*b* of the fixed scroll 1.

Figure 10:
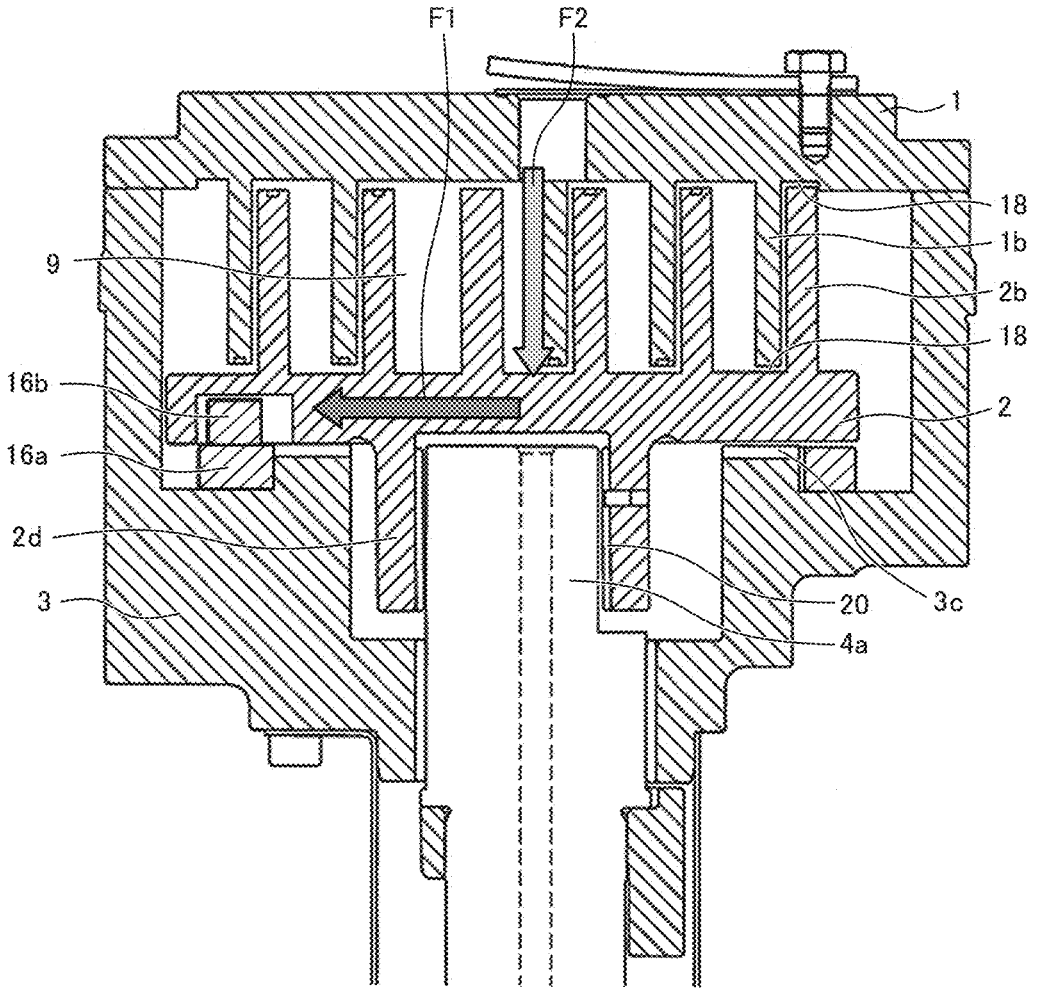
FIG. 10 is a schematic enlarged view of a compression mechanism including a fixed crank mechanism as a modification of the scroll compressors according to Embodiments 1 and 2 of the present invention.

The present invention can be applied not only to the scroll compressor including the driven crank mechanism but also to a scroll compressor including a fixed crank mechanism as illustrated in FIG. 10, which will be described below.

FIG. 10 is a schematic enlarged view of a compression mechanism including a fixed crank mechanism as a modification of the scroll compressors according to Embodiments 1 and 2 of the present invention.

In this modification, the fixed crank mechanism is used instead of the driven crank mechanism, as illustrated in FIG. 1, in Embodiments 1 and 2. Specifically, in the mechanism in this modification, the bushing 15 is eliminated, the eccentric pin 4*a* is connected to the recessed bearing 2*d* with the orbiting bearing 20 interposed between the eccentric pin 4*a* and the recessed bearing 2*d*, and the second spiral element 2*b* of the orbiting scroll 2 is not in contact with the first spiral element 1*b* of the fixed scroll 1.

As the bushing 15, which is radially movable, is eliminated in this modification, the second spiral element 2*b* of the orbiting scroll 2 does not contact the first spiral element 1*b* of the fixed scroll 1 even when a centrifugal force acts on the orbiting scroll 2 during operation, and a small radial gap is thus left between the first spiral element 1*b* of the fixed scroll 1 and the second spiral element 2*b* of the orbiting scroll 2. Consequently, when the overturning moment M acting on the orbiting scroll 2 excessively increases and the orbiting scroll 2 tilts accordingly, the orbiting scroll 2 tilts until the second spiral element 2*b* of the orbiting scroll 2 contacts the first spiral element 1*b* of the fixed scroll 1. In such a case, the angle of tilt is larger than that in the scroll compressor including the driven crank mechanism.

Consequently, the present invention, in which the angle of tilt of the orbiting scroll 2 is reduced, exerts effects particularly on a configuration including such a fixed crank mechanism.

REFERENCE SIGNS LIST

1 fixed scroll 1*a* discharge port 1*b* first spiral element 1*c* first end plate 2 orbiting scroll 2*b* second spiral element 2*c* second end plate 2*d* recessed bearing 2*e* rear surface 3 frame 3*b* bearing 3*c* thrust bearing crankshaft 4*a* eccentric pin 5 suction pipe 6 rotor 7 stator 8 shell compression chamber 10 valve hold-down part 11 valve 12 oil sump discharge pipe 14 high-pressure space 15 bushing 15*a* slide hole 15*aa* flat part 15*ab* curved part 16 Oldham ring 16*a* ring portion 16*b* Oldham key 16*c* support 17 sealing part 18 gap 19 subframe 19*a* sub bearing 20 orbiting bearing 21 oil pump 22 oil circuit 23 gap 35 compression mechanism 36 drive mechanism 100 compressor 160*c* support F1 resultant force F2 thrust load M overturning moment O fulcrum

The invention claimed is:

1. A scroll compressor, comprising:

a fixed scroll including an end plate and a spiral element on the end plate;

an orbiting scroll including an end plate and a spiral element on the end plate of the orbiting scroll, the spiral element of the orbiting scroll engaging with the spiral element of the fixed scroll to define a compression chamber;

a crankshaft configured to drive the orbiting scroll;

a frame supporting the orbiting scroll across the orbiting scroll from the fixed scroll; and an Oldham ring disposed between the end plate of the orbiting scroll and the frame, the Oldham ring being configured to prevent the orbiting scroll from rotating to allow the orbiting scroll to orbit against the fixed scroll, the Oldham ring including a ring portion that is annular, a surface of the ring portion facing the end plate of the orbiting scroll including a support to contact the orbiting scroll when the orbiting scroll tilts during an orbiting motion of the orbiting scroll, the scroll compressor satisfying a relation of $\delta 1 > \delta 2$, where $\delta 1$ denotes an axial length of each of a gap between a tip of the spiral element of the orbiting scroll and the end plate of the fixed scroll and a gap between a tip of the spiral element of the fixed scroll and the end plate of the orbiting scroll, and $\delta 2$ denotes an axial length of a gap between the end plate of the orbiting scroll and the support of the Oldham ring.

2. The scroll compressor of claim 1, wherein the support comprises a protrusion disposed on the surface of the ring portion facing the end plate of the orbiting scroll.

3. The scroll compressor of claim 2, wherein the protrusion comprises at least one protrusion disposed on each of four arc-shaped portions, the four arc-shaped portions being defined by circumferentially equally dividing the surface of the ring portion facing the end plate of the orbiting scroll into four areas.

4. The scroll compressor of claim 1, wherein the Oldham ring is made from any of carbon steel for machine construction, an iron-based sintered material, an aluminum die-casting, and an aluminum forging.

5. The scroll compressor of claim 1, wherein the Oldham ring includes a surface treatment layer obtained by any of nitriding, manganese phosphating, and diamond-like carbon.

6. The scroll compressor of claim 1, further comprising a steel sheet attached to a surface of the orbiting scroll opposite a surface of the orbiting scroll on which the spiral element is disposed.

7. The scroll compressor of claim 1, wherein a fluid to be compressed in the compression chamber is a single component refrigerant or a refrigerant mixture containing the single component refrigerant, the single component refrigerant having a molecular formula expressed as $C_3H_mF_n$ and one double bond in a molecular structure of the single component refrigerant, where m and n are each an integer of 1 to 5 and a relation of m+n=6 is satisfied.

8. The scroll compressor of claim 7, wherein the single component refrigerant is 2,3,3,3-tetrafluoro-1-propene.

* * * * *